US006131785A

United States Patent [19]

Anderson et al.

[11] Patent Number: 6,131,785

[45] Date of Patent: Oct. 17, 2000

[54] AIR JET PIDDLING

[75] Inventors: Frank William Anderson; James Victor Hartzog, both of Kinston; Darren Scott Quinn, Goldsboro, all of N.C.

[73] Assignee: E. I. du Pont de Nemours and Company, Wilmington, Del.

[21] Appl. No.: 09/141,119

[22] Filed: Aug. 27, 1998

Related U.S. Application Data

[63] Continuation-in-part of application No. 08/904,167, filed as application No. PCT/US98/15317, Jul. 31, 1998, Pat. No. 6,032,844.

[51] Int. Cl.[7] ..... B65H 20/00; B65H 54/76; D04H 11/00; D02G 1/16

[52] U.S. Cl. ..... 226/97.4; 19/159 R; 28/274; 28/289

[58] Field of Search ..... 226/97.4; 28/274, 28/289; 19/159 R

[56] References Cited

U.S. PATENT DOCUMENTS

| | | | |
|---|---|---|---|
| 2,173,789 | 9/1939 | Nikles et al. | 226/97.4 X |
| 2,447,982 | 8/1948 | Koster . | |
| 2,721,371 | 10/1955 | Hodkinson et al. . | |
| 2,971,243 | 2/1961 | Burns | 226/97.4 X |
| 3,052,010 | 9/1962 | Martin . | |
| 3,135,038 | 6/1964 | Pflugrad . | |
| 3,270,977 | 9/1966 | Tillou, II . | |
| 3,281,913 | 11/1966 | Morehead et al. . | |
| 3,387,756 | 6/1968 | Goodner . | |
| 3,580,445 | 5/1971 | Moore, Jr. . | |
| 3,706,407 | 12/1972 | King et al. . | |
| 3,951,321 | 4/1976 | Heusser | 226/97.4 |
| 4,098,444 | 7/1978 | Cole | 226/97.4 |
| 4,414,790 | 11/1983 | Sighieri et al. | 226/97.4 X |
| 4,784,344 | 11/1988 | Lenk et al. | 226/97.4 X |
| 5,326,009 | 7/1994 | Kobayashi et al. | 226/97.4 |
| 6,032,844 | 3/2000 | Hartzog et al. | 226/97.4 |

FOREIGN PATENT DOCUMENTS

| | | |
|---|---|---|
| 367371 | 3/1963 | Switzerland . |

*Primary Examiner*—Michael R. Mansen

[57] ABSTRACT

An aspirating jet piddler that has no moving parts and operates to achieve a soft laydown with reduced tangling.

13 Claims, 3 Drawing Sheets

AIR JET PIDDLING

CROSS-REFERENCE TO RELATED APPLICATIONS

This application is a continuation-in-part of application Ser. No. 08/904,167, now U.S. Pat. No. 6,032,844 filed by Hartzog and Quinn on Jul. 31, 1997, and also claims benefit of priority from PCT/US98/15317, filed Jul. 31, 1998.

FIELD OF THE INVENTION

This invention relates to improvements in and relating to air jet piddling, and more particularly to an improved piddler that uses an air jet and to an improved process relating thereto and to improved products obtained thereby.

BACKGROUND OF THE INVENTION

An integral step in many processes or systems for the production of textile fibers has been the collection of a rapidly moving multifilamentary strand in a container for transport to the next processing step. This process, often called piddling or canning, has provided a means by which one or more filamentary strands (referred to herein as tow or rope) were collected and possibly combined before processing through a draw/crimp step, which is often performed at a speed that has generally been much slower than the previous step, such as, for example, spinning a synthetic polymer to form synthetic filaments. A long-standing problem in the piddling process has been how to deposit such a rapidly-moving line into the can in such a way as to avoid entanglements that may be a problem particularly upon subsequent removal of product from the can. Several methods are available commercially and/or have been published.

The system of piddling a textile rope that is currently preferred commercially involves using a pair of toothed rolls to pull a tow from the primary (withdrawal) spinning rolls. Such toothed rolls, often referred to as gear rolls, gear plaiters or sunflower rolls, are available on piddler systems marketed by IWKA, Neumag, and Fleissner, for example. In these units, the toothed rolls are intended to pull the tow strand from a previous roll and to release the strand in such a way that it (1) does not wrap any rolls, and (2) is distributed so as to land softly in the can. To accomplish the first objective (a low wrap potential), large diameter rolls are used with many teeth to provide a small fiber contact area at the tip of each tooth. To enhance release of the filaments, the teeth are often coated with a low friction material and the surface speed of the toothed rolls is often greater than the speed of the moving tow band to enable the teeth to slip over the fibers and to avoid developing too much static friction. A soft landing of the moving tow line into the can is caused primarily by converting a large portion of the velocity of the moving tow band into a horizontal component. This is accomplished primarily by intermeshing the teeth from the two adjacent rolls so that the tow band folds upon itself. The vertical component of the velocity is further reduced by the tendency of filaments to adhere intermittently and momentarily to the teeth, which can cause the band to pull off its centerline and/or to open. We have noted several problems with this type of piddler. Their use is often limited in practical operations to low speeds of less than 1000 m/min owing to the difficulty of moving such (large diameter) sunflower rolls at high revolutions; we have experienced increased incidence of wraps at higher speeds. In addition, for a given product, we have found that the operating range of this type of equipment can often be relatively narrow, especially with certain types of filaments. In many instances, we have found that a mesh between the rolls that is too loose will result in poor can lay and resultant tangles, while a mesh that is too tight will result in the tow line wrapping the sunflower rolls. Wraps have also frequently been caused by wear and chipping of any low friction coating applied to the tooth surfaces. The higher speed of the sunflower roll teeth relative to the fibers can also result in broken filaments, which in turn can lead to dark dyed sections in subsequent fiber or fabric processing. Sometimes maintaining tension between the sunflower rolls and previous rolls has also been difficult. The nature of this type of piddler requires that only a light force be imparted on the filaments by the faster moving sunflower rolls since it is not desired to stretch the filaments at this point and since the higher speeds and/or tighter roll mesh required to give more tension can also result in sunflower roll wraps. To summarize, various problems have been experienced in practical operation of the toothed roll systems that are available commercially and improvements are desirable, especially when processing certain specific types of filaments on such toothed roll piddler systems.

Disclosures of using a pneumatic jet for depositing textile tows date back almost 50 years, e.g., Koster in U.S. Pat. No. 2,447,982, Burns in U.S. Pat. No. 2,971,243, King et al in U.S. Pat. No. 3,706,407, and Goodner in U.S. Pat. No. 3,387,756. All of the above prior suggestions for using a pneumatic (or aspirating) jet have required rotating mechanical parts and angling of a discharge tube away from the tow line's vertical inlet position, which require complex apparatus, often in relation to rotating air joints and seals, and their maintenance. We believe that such air jet piddlers are not being offered commercially now, although they had been suggested in the art and had been offered in earlier years, before gear piddlers became favored. Koster deposited his continuous filamentary material 2 in the form of a heaped coil or numerous staggered, partially over-lapping loops (col 1, lines 23–26) by passing his filamentary material with a stream of fluid through an outlet tube 11 that had a bend at 12 (so that the lower portion was angled) and a second bend at 13 so that discharge of the fluid caused rotation of tube 11 (col 2, lines 1–34 and the drawing). Burns referred to prior methods of blowing textile material through a tube revolving about an axis to deposit the textile material in the form of piled or over-lapping loops or coils and warned about difficulties caused by entanglement of filaments and obtaining "non-uniformly drawn sections" and so Burns' objective was to deposit his filaments without looped or entangled filaments so the filaments in his tow bundle would remain essentially parallel (col 1, lines 1–41). Burns used an air jet 5 that was rotated to discharge the tow at an angle in the form of a helical coil (e.g., col 2, especially lines 19–25 and FIG. 1). Burns emphasized placing his air jet 5 at the delivery end of his rotatably mounted apparatus and warned that attempts to operate with the jet in the vertical path of travel of the tow bundle had always led to excessive amount of entanglement (col 3, lines 58–67). Goodner is entitled "Pneumatic Jet Tow Piddler", requirements then being to propel heavy denier tows at high speeds while simultaneously laying (them) in coils, by spirally dispensing them into large containers or cans (col 1, lines 10–17). Goodner used a rotatably mounted jet with a nozzle 22 having a curved end to effect deposition in coils (e.g., col 2, lines 59–65 and FIG. 1). King referred to Koster and Burns, and talked of the need for a rotating drive (as used by Burns, rather than Koster's technique) to avoid disruptive air currents that would disturb the more or less parallel relation of the filaments that was considered desirable and the need to avoid any fiber-catching joint (e.g., col 1, lines 22–58).

What is notable, in retrospect, was that the desire to avoid entanglement of the filaments was naturally associated in the minds of those skilled in the art with the desirability of preserving the essentially parallel relation of the filaments which seemed to them to mean that the tow bundle should be kept integral in separate coils, i.e., that filaments from one coil should not be allowed to intrude into another coil and entangle, which caused problems when the tow was later withdrawn from the can.

SUMMARY OF THE INVENTION

In contrast, according to the present invention, a single fixed jet with no moving parts may be positioned directly above the can into which the tow is piddled. This jet may be positioned vertically and requires no mechanical device or discharge tube to bend the tow line. Surprisingly, we have found advantages in that the emerging tow line has been able to enter the can softly in such a manner that entanglements are reduced and may be avoided completely when the tow is subsequently removed from the can. A tow can thus be pulled at speeds equal to and greater than those achievable earlier. We have, for instance, achieved speeds of 2000 mpm using our novel device, and we feel confident that much higher speeds could be achieved successfully.

According to one aspect of the present invention, therefore, we provide a piddler for collecting a rapidly-moving tow of multiple continuous filaments and depositing said tow of multiple continuous filaments into a container, wherein said piddler comprises an aspirating jet 14, comprising inlet tube 24 and outlet pipe 29 for passing the tow 11 down therethrough in an axial direction, and outer housing 27 provided with a straight-in inlet port 23 for aspirating gas, said inlet tube 24 and said outer housing 27 providing therebetween an annular space 28 for passing the aspirating gas therethrough, whereby the aspirating gas is enabled to pull the tow 11 down through and out of said inlet tube 24 and into said outlet pipe 29 and to discharge the tow out of said outlet pipe 29 into the container 15 as a tow of multiple continuous filaments without swirling as a tow line, wherein said outlet pipe 29 is rigidly mounted and not rotatable with respect to jet 14.

According to another aspect of the invention, we provide a process for depositing a multifilamentary textile tow gently into a container, comprising using an aspirating jet with no moving parts to forward the tow through said jet in a straight line path and to deposit the tow into the container.

Also provided are other apparatus and process aspects, and products therefrom, as disclosed herein.

The aspirating jet piddler according to the invention may be incorporated into a piddler system according to the prior art, such as one of the sunflower or gear piddlers that are commercially available, but is preferably substituted as a replacement for a commercially available system.

Placement of the tow may be into any of several can and laydown configurations. Typical laydown systems, all of which are applicable to the present invention, include those that move a can and/or the jet in both X and Y directions, those in which a can rotates, those where a cylindrical, motionless can is used, those in which a round can both rotates and traverses, those in which a piddler head traverses while the can spins and other possible configurations. This novel piddler facilitates by simplifying machine design and allows for even deposition of a rapidly moving tow into a can in such a way that a large quantity can be placed in a can and thus reduce down time, e.g., in a subsequent processing step.

DESCRIPTION OF PREFERRED EMBODIMENTS

Figure 1:
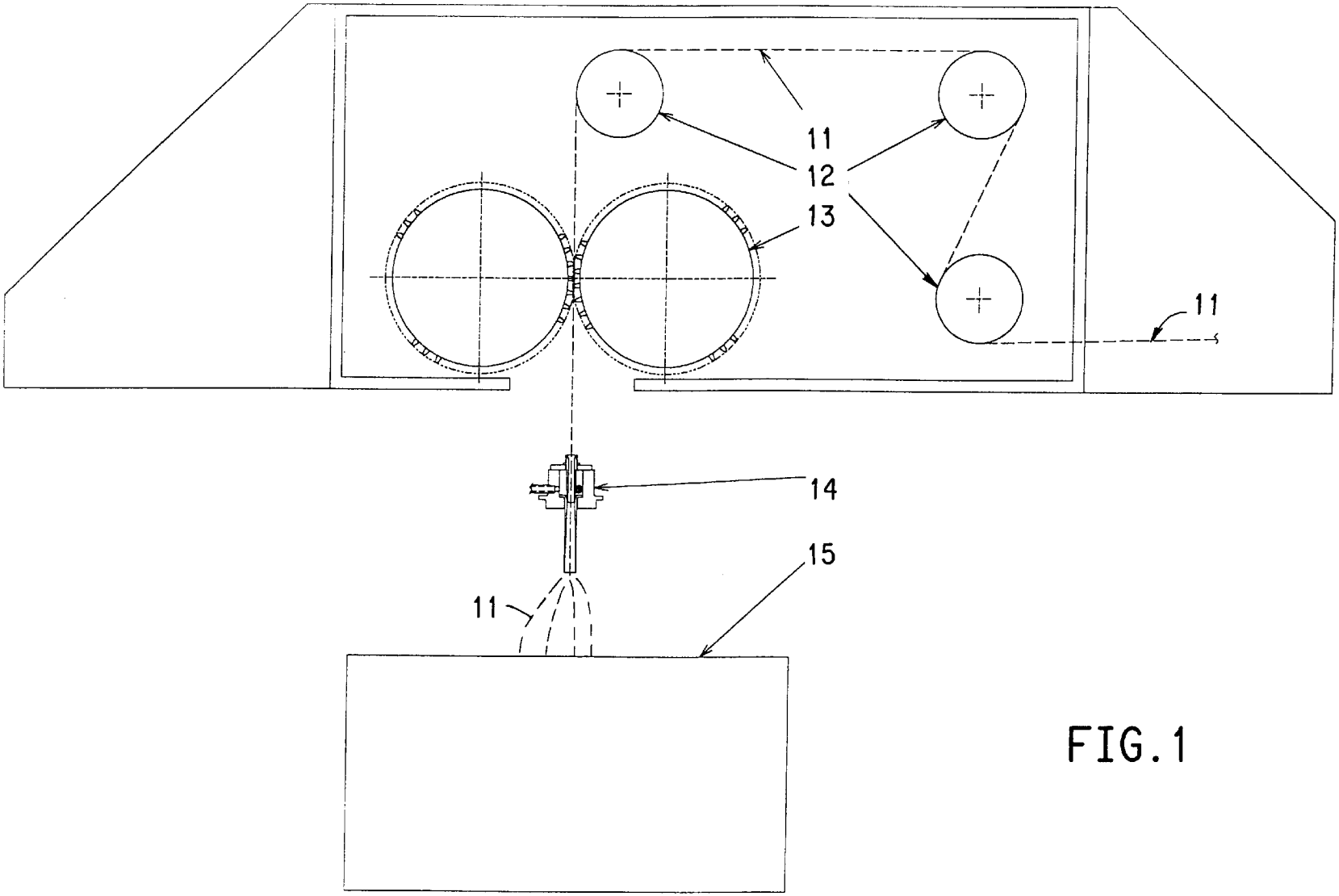
FIG. 1 is a schematic illustration in elevation of one embodiment of the invention, in combination with a sunflower roll piddler system.
Figure 2:
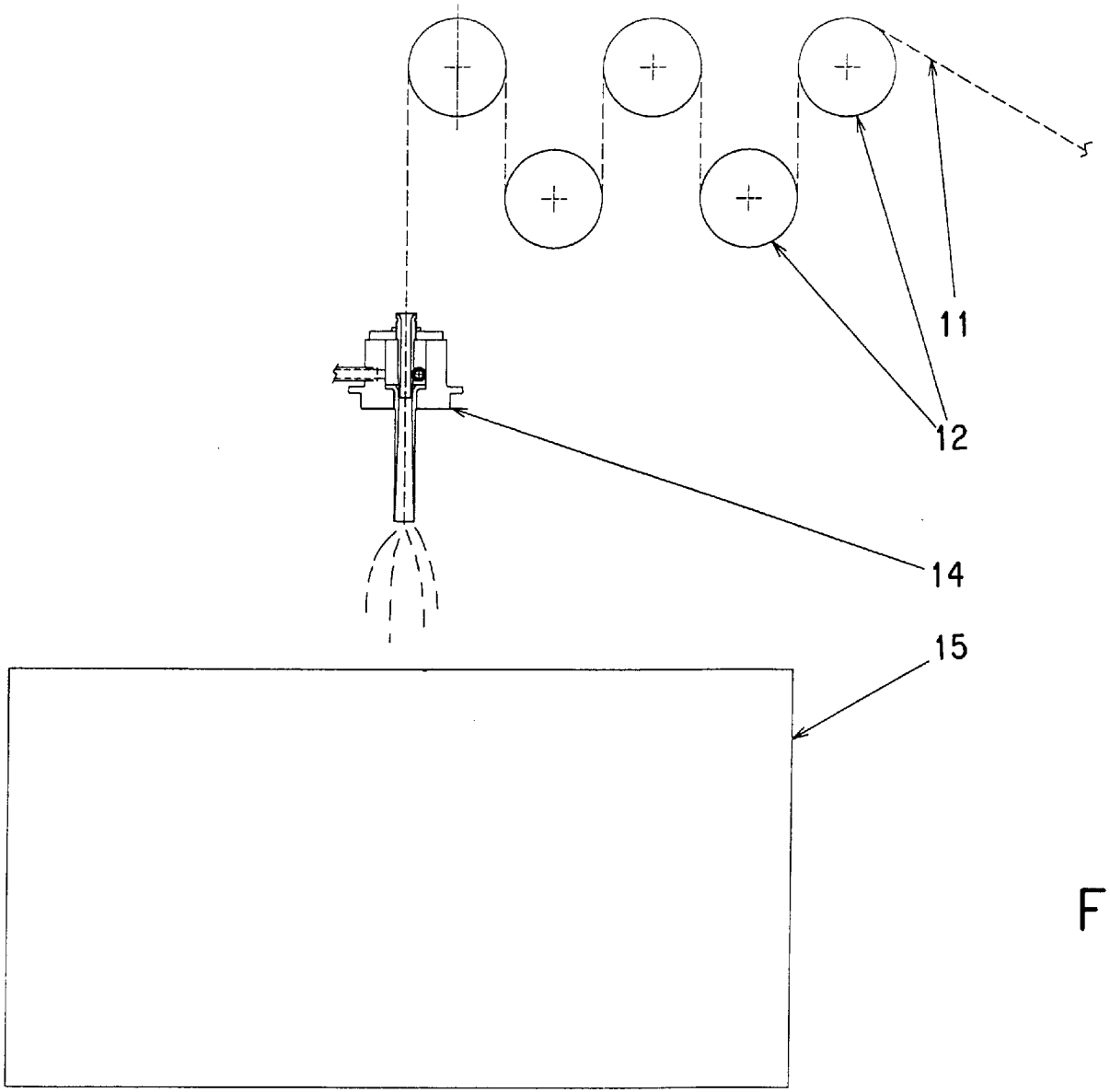
FIG. 2 illustrates similarly an embodiment of the invention as part of a preferred piddler system without the sunflower roll.
Figure 4:
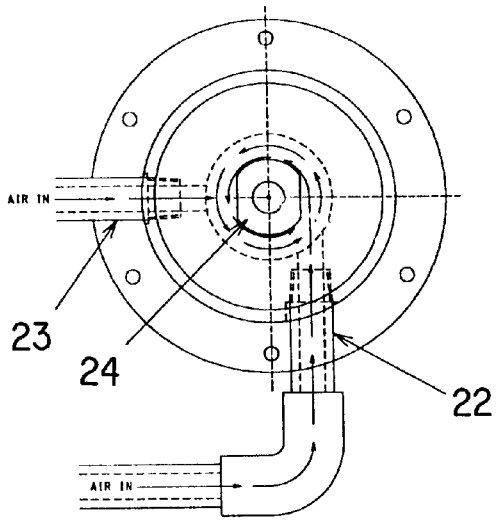
FIG. 4 is a similar plan view from above of the embodiment of FIG. 3.
Figure 3:
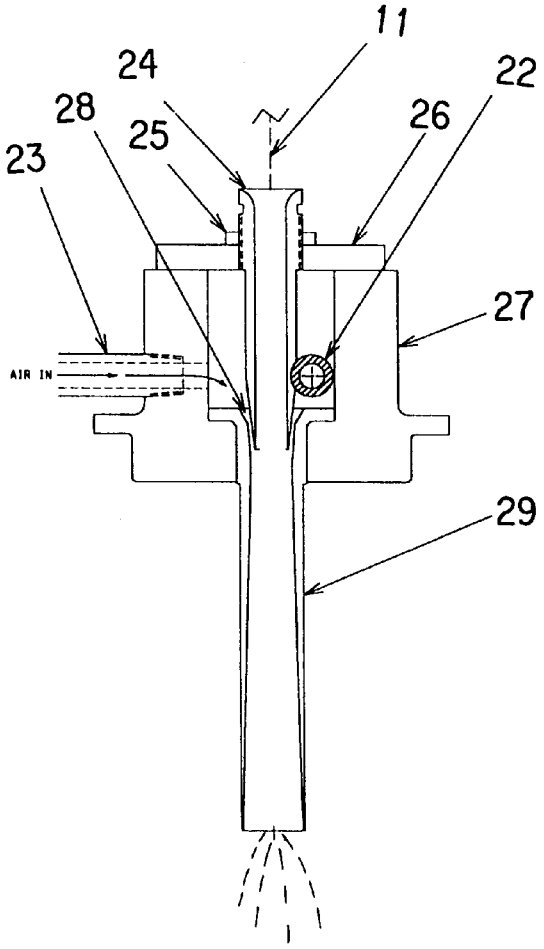
FIG. 3 is a schematic view in elevation and in section of a preferred embodiment of the invention.

Referring to the drawings, FIGS. 3 and 4 illustrate the aspirating jet which is shown generally as 14 in FIGS. 1 and 2. In FIG. 1, the jet 14 is shown in combination with "Sunflower rolls" 13 of a commercial piddler unit. In this unit, a moving tow 11 is pulled by rolls 12 from a spinning machine (not shown). Sunflower rolls 13 pull the tow 11 from rolls 12. Thus far, FIG. 1 follows practice in a conventional commercial piddler system. Then, according to the invention, our stationary piddler jet 14 pulls the tow 11 from the sunflower rolls 13 and deposits it into a container 15. In FIG. 2, the piddler jet 14 is shown in a preferred embodiment where a tow 11 is pulled from a spinning machine by a set of rolls 12 from which it is pulled by the stationary piddler jet 14 and deposited into container 15.

In FIGS. 3 and 4, the tow 11 enters the jet via inlet tube 24, and emerges from outlet pipe (a tailpipe) 29, shown in FIG. 3, outlet pipe 29 being a continuation of an outer housing 27. The stationary piddler jet itself comprises also a straight-in air inlet port 23, which directs air or other aspirating fluid into outer housing 27 in a direction perpendicular to the path of the tow 11, and preferably a vortexing air inlet port 22, which directs air in a direction tangential to the path of the tow 11. Both ports are connected to a source or sources of pressurized gas, typically air, typically in a range of 25 to 100 psig (2.75 to 8 atmospheres), these sources not being shown. The air enters outer housing 27 which is sealed by cover plate 26, and is forced to leave the housing 27 through annular space 28 between the inlet tube 24 and the outlet pipe 29, being a continuation of outer housing 27. The motive force of the air may be controlled by the relationship between inlet tube 24 and outlet pipe 29 which creates the annular space 28 and may be adjusted by raising or lowering inlet tube 24 which may be externally threaded, e.g., to the cover plate 26, and may be secured in place, e.g., by lock nut 25. The air inlets are conveniently located so that the straight-in air from port 23 travels through the annular space in a direction essentially parallel to that of the moving tow 11, whereas any vortexing air will swirl or spiral through the annular space in a direction roughly tangential to that of the tow 11 and similarly through the outlet pipe 29. The entrained tow 11 is thus pulled downward through the jet and a swirling force may be created by any vortexing air. This may cause the filaments also to swirl spirally (in a circular pattern) as they are discharged from the jet through outlet pipe 29. However, we now believe that swirling of the filaments as a unitary tow line is not necessary, and not so important as was postulated in prior application Ser. No. 08/904,167, referred to hereinabove. The ability to use vortexing air provides flexibility as a means to adjust the air pressure when piddling different tow lines with varying characteristics.

It will be noted that this novel air jet piddler has no moving parts, which is an important practical advantage, both for simplicity of manufacture, and in practical operation and maintenance.

EXAMPLES

The invention is further described in the following Examples, which include comparative data to demonstrate advantages achieved by the use of the present invention; all parts and percentages are by weight.

Comparison A

A tow of polyester filaments was processed according to the prior art, utilizing a gear piddler (such as commercially available from IWKA, Karlesruhe, Germany) to pull a multifilamentary tow in the form of a band of unoriented as-spun filaments from a spinning apparatus and to deposit said tow in a can. The polyester filaments were bicomponent filaments prepared essentially as described in U.S. Pat. No. 5,458,971, the combined polymer throughput being 182 lbs. per hr. (82.6 Kg/Hr.), and the ratio of polymer A to polymer B was 78:22. At speeds above 600 ypm (549 m/min) slippage on the piddler rolls was observed, and was so severe that run times were limited to 30 minutes or less before the multifilamentary band would wrap one of the rolls and force a complete machine shutdown.

Example 1

To overcome this problem experienced in Comparison A, a stationary air jet was added below the nip of the piddler's gear rolls, essentially as illustrated in FIG. 1. This stationary air jet is designed so that air enters the jet housing from two locations. The first air inlet port is situated such that the air directly impinges on the tube surrounding the filaments and thus flows out of the jet past the tube's tip in a direction parallel to and entraining the filaments. The second air inlet is situated such that the air enters in a direction that is tangential to the direction of flow of the filaments. This causes a vortexing effect on the entrained filaments and we noted that they were caused to spiral as they left the jet's tailpiece. The suction power of the jet can be controlled by regulating the air pressure and flow. In addition, by regulating the ratio of the vortexing air to the other air, we controlled the amount of spiral imparted to the rope band.

With the jet described above, similar tow processed as described for Comparison A was spun and piddled into the container satisfactorily at more than twice the maximum speed achieved in Comparison A, i.e. at speeds up to 1360 ypm (1244 mpm). Tension throughout the piddler was good and there was no tendency to wrap the rolls when this piddler was used according to this Example 1.

Example 2

A comparative test was run with tow processed essentially as described in Example 1 at a speed of 500 ypm (457 mpm), and the resulting tow was then withdrawn from the container and processed through a draw machine equipped with a device that detects knotted rope before it enters the draw machine's feed section. The machine's logic controls will then shut the machine down to prevent a knot from damaging the equipment. Tangles and knots were recorded for the product produced as described in Example 1 and were compared to historical data over a six month period on the same product produced previously without using the stationary air jet (i.e., essentially as described for Comparison A) at 500 ypm.

TABLE 1

| ITEM | TANGLES PER 100 RUN HOURS |
|---|---|
| A | 132.5 |
| AS EXAMPLE 1 | 78.6 |

As can be seen, use of the stationary air jet reduced the number of tangles during extraction from the can to about 60% of the number recorded as experienced previously.

The appearance of the filaments in the containers as produced in Examples 1 and 2 was similar to that described hereinafter, after Example 3, and quite unlike the appearance of tow piddled using commercial gear piddlers, as described in Comparison A or Comparison B.

Comparison B

A tow of polyester filaments was processed according to the prior art, utilizing a Neumag gear piddler to pull a multifilamentary tow in the form of a band of unoriented as-spun filaments from a spinning apparatus and to deposit said tow in a can. The polyester filaments were polyethylene terephthalate of 20.5 LRV prepared using a conventional polyester polymerization unit. The molten polymer stream was extruded at each position at a rate of 63 kg/hr through a spinneret containing 2600 holes and cooled using a stream of gas below the spin cell to form solid round fibers. The resulting bundle of filaments was combined with similar bundles from another 63 positions and the resulting tow was deposited into a container at a maximum speed of 1450 mpm using the gear piddler. Tows were withdrawn from several containers and were combined to form a rope bundle and drawn using conventional polyester methods to produce a 1.2 dpf fiber having a 6.4 gm/den tenacity.

Gear piddler operation in this Comparison B had to be limited to 1450 mpm since excessive piddler wraps (greater than one per 8 hr. shift) resulted when attempts were made to use higher spin speeds. A liquid loading of 20% by weight in spinning was required to attain product removal from the containers for the subsequent drawing operation. At lower liquid loading, knots and tangles were excessive when attempts were made to withdraw such tows piddled according to Comparison B.

Example 3

To overcome the problems experienced in Comparison B, the gear piddler was replaced with a stationary air jet essentially as illustrated in FIGS. 2, 3 and 4 and as described in Example 1. Inlet tube 24 was of internal diameter 0.54 inches (13.7 mm) and length 5.75 inches (146 mm), outlet pipe 29 was of 0.683 inches (17.3 mm) and length 8.38 inches (213 mm), the total length from top of inlet tube 24 to bottom of outlet pipe 29 being 13.75 inches (about 35 cm). The entrained filaments were drawn through the jet outlet pipe 29 and entered an extended stationary tailpipe, of internal diameter 1.125 inches (28.6 mm) and length 1 foot (about 30 cm), which directed the filaments toward the can. The tailpipe in effect extended the length of the outlet pipe and brought the filaments closer to the can, which was located farther from the air jet than in Example 1. As the air was discharged from the tailpipe, it tended to expand and cause filaments to balloon outwards, so essentially no swirling of the filaments was noticed. This ballooning in effect enabled the filaments to float down and land softly and the filaments did not become entangled in the piddler can, as shown by the fact that the tow could be removed satisfactorily.

Using this jet instead of the gear piddler, a tow similar to that described for Comparison B was spun at speeds up to 1980 mpm with a spinning cell thruput of 83 kg/hr/pos. Tension of the spinning threadline was good and there was practically no tendency to wrap the piddler rolls when this jet piddler was used according to the invention. Piddler wraps were reduced to less than one per month. In this Example, using the piddler jet according to the invention, the liquid loading in spinning was reduced from 20% to 5% without hindering satisfactory removal of the product from the containers. No knots or tangles were encountered during product removal.

In addition the jet permitted direct laydown of the as-spun tow into a square can (vs orbital laydown into a round can). Square or rectangular cans provide more effective use of space in the plant and while transporting tow. Such more effective use can provide over 25% improvement in efficiency. Furthermore, such larger containers can provide for a more than 24 hour run cycle on the downstream drawing process, which, for us, has provided a resultant 6% improvement in machine utilization and a much larger (more than 60% for us) reduction in yield loss owing to undrawable product remaining in the can at the end of each cycle.

It will be noted that significant advantages were obtained by using the jet piddler according to the invention in Example 3 instead of one of the commercially-available gear piddlers that have been preferred for commercial operations, as follows:

1—higher operational speed—1980 mpm for Example 3 vs. 1450 mpm for Comparison B, i.e., about one third faster—this increase in piddling speed is more significant than merely providing better productivity in piddling, as the maximum speed obtainable hitherto by commercially-available piddlers has limited spinning speeds, which could have been much higher but have been limited, in practice, by a bottleneck of maximum practical piddling speed. Higher spinning speeds can also provide different properties in the resulting as-spun filaments, and thereby have far-reaching effects downstream. We are confident that much higher speeds could be achieved, the limitation in Example 3 being because of limitations in the speeds that these particular rolls could be operated at, rather than any limitation relating to the air jet.

2—less tangling and knots—the inability to improve piddling speed without excessive tangling and knots when subsequently withdrawing a tow has been an important factor previously—a surprising result of the present invention in this regard is discussed separately hereinafter.

3—lower liquid loading—only 5% in Example 3 vs a minimum of 20% in Comparison B to get the maximum speed obtainable in Comparison B. "Liquid loading" is the weight of liquid (spin finish and possibly extra water) as a percentage of the weight of fiber. Higher liquid loadings have typically helped reduce knots and tangles produced by a gear piddler by causing the tow to act as a large cohesive rope that is less likely to knot upon itself. In addition, the liquid adds weight to the tow so that, if a weak knot does form, it is more likely to fall out as the tow is pulled up out of the can. Further, some operators have added more water as an overlay, in addition to the liquid loading of the tow that passes through the gear piddler, e.g., at a rate of about 1 gallon/minute, to help compact down the coils of tow in the can. Although such high liquid loadings have been used to increase the speeds possible using prior art commercially-available gear piddlers, they increase cost by requiring more liquid (spin finish) to be added and also cause problems subsequently, e.g., during drawing.

4—fewer roll wraps—less than 1 per month for Example 3 vs Comparison B, in which the maximum speed was limited by the requirement for less than 1 per 8 hr shift.

5—higher throughput—83 kg/hr in Example 3 vs 63 kg/hr in Comparison B.

6—square containers in Example 3 vs round cans in Comparison B—square or rectangular containers can provide more efficient use of space vs round cans which have been conventional because commercially-available piddlers have historically distributed the piddled tow in a pattern that favors a rounded cross-section—the surprising advantage obtained thereby has been noted at the end of Example 3.

What has been even more surprising to us has been the difference in the nature of the filamentary material produced in the containers according to the invention in contrast to the coils of tow piddled according to the prior art. As has been noted in the Background and in relation to "liquid loading", hereinabove, the important objective of avoiding entanglement or knots when withdrawing a piddled tow from a container was naturally associated with maintaining a cohesive and integral filamentary bundle during laying of the bundle into the container. The ballooning outwards and floating of the filaments that we have described in Example 3 is the exact opposite of what has hitherto been considered desirable (maintaining a cohesive and integral filament bundle that is laid into the container as such). To all appearances, the outwardly ballooning filaments discharged from the piddler according to the invention and the apparently random mass of filaments laid in the container seem to be distributed in a way that has appeared undesirable for withdrawing the container without knots and tangles to those skilled in the art, such as ourselves, who have been used to ensuring laying a cohesive and integral rope bundle so as to avoid entanglement upon subsequently withdrawing the tow. Indeed, operators should be warned not to drop the end of the tow or filaments therefrom into the container when a container has been filled and the tow is cut and introduced into another container, as it has proved hard to find the end (after it has been dropped into a container) of such tows as we have piddled because of the lack of bundle integrity of our tows in contrast to prior art tows. Nevertheless, provided the cut end is properly secured, as can be seen from the results in the Examples above, it has proved possible to withdraw the product tows of our invention from containers with less tangles or knots than when using commercially-available gear piddlers.

We have used successfully jets with inlet tubes 24 of internal diameter either 0.540 inches (13.7 mm) or 0.514 inches (13.1 mm), and generally use as small diameter as will run satisfactorily for any particular tow without problems.

What is claimed is:

1. A piddler for collecting a rapidly-moving tow of multiple continuous filaments and depositing said tow of multiple continuous filaments into a container, wherein said piddler comprises:

an aspirating jet comprising an inlet tube and an outlet pipe, wherein said outlet pipe has an inner surface that flares substantially outward, said inlet tube and said outlet pipe being aligned axially and substantially in a vertical direction for passing the tow down therethrough in an axial and substantially vertical direction, and an outer housing provided with a straight-in inlet port for aspirating gas, said inlet tube and said outer housing providing there between an annular space for passing the aspirating gas therethrough, whereby the aspirating gas is enabled to pull the tow down through and out of said inlet tube and into said outlet pipe while remaining in an axially and substantially vertically aligned path, and to discharge the tow directly out of the substantially flared inner surface of said outlet pipe and into the container as a tow of multiple continuous filaments without bending or swirling as a tow line, wherein said aspirating jet is rigidly mounted and not rotatable.

2. The piddler as recited in claim 1, wherein said aspirating jet pulls said tow from a set of rolls incorporated in a spinning machine.

3. The piddler as recited in claim 1, wherein said annular space may be adjusted by raising or lowering said inlet tube.

4. The piddler as recited in claim 3, wherein said inlet tube is externally threaded, and secured in place by an external lock nut.

5. The piddler as recited in claim 1, wherein said container comprises a square configuration.

6. The piddler as recited in claim 1, wherein said container comprises a rectangular configuration.

7. The piddler as recited in claim 1, wherein said multiple continuous filaments are polyester.

8. A process for depositing a multifilamentary textile tow gently into a container, comprising using a non-rotating aspirating jet having an axially aligned inlet tube and a substantially outwardly flaring outlet pipe, said aspirating jet forwarding the tow through said jet in a straight and substantially vertical line path wherein said tow extends directly from said substantially outwardly flaring outlet pipe and into the container without bending or swirling.

9. The process as recited in claim 2, wherein said aspirating jet pulls said tow from a set of rolls incorporated in a spinning machine.

10. The process as recited in claim 2, wherein said container comprises a square configuration.

11. The process as recited in claim 2, wherein said container comprises a rectangular configuration.

12. The process as recited in claim 2, wherein said multifilamentary textile tow is polyester.

13. The process as recited in claim 2, wherein said non-rotating aspirating jet further comprises:

an outer housing provided with a straight-in inlet port for aspirating gas, said inlet tube and said outer housing providing there between an annular space for passing the aspirating gas therethrough, whereby the aspirating gas is enabled to pull the tow down through and out of said inlet tube and into said outlet pipe while remaining in a straight and substantially vertical line path, and to discharge the tow out of said outlet pipe into the container as a tow of multiple continuous filaments.

* * * * *